United States Patent [19]

Yokota

[11] 4,117,877

[45] Oct. 3, 1978

[54] METHOD OF MANUFACTURING LARGE-SIZED CENTRIFUGALLY CAST COMPOSITE ROLL AND DEVICE FOR DISPOSING LOWER SIDE POURING SPRUE RUNNER USED IN THE METHOD

[75] Inventor: Reizo Yokota, Osaka, Japan

[73] Assignee: Kabushiki Kaisha Yodogawaseikosho, Osaka, Japan

[21] Appl. No.: 853,846

[22] Filed: Nov. 22, 1977

[51] Int. Cl.[2] ..... B22D 19/08; B22C 9/20

[52] U.S. Cl. ..... 164/95; 164/137; 164/339

[58] Field of Search ..... 164/23, 27, 95, 98, 164/99, 137, 167, 168, 339, 288, 363, 340, 341, 342, 343, 332-334; 249/108, 109

[56] References Cited

U.S. PATENT DOCUMENTS 3,670,800 6/1972 DeVos ..... 164/95

*Primary Examiner*—Francis S. Husar
*Assistant Examiner*—K. Y. Lin
*Attorney, Agent, or Firm*—Koda and Androlia

[57] ABSTRACT

The disclosure relates to a method of manufacturing a large-sized centrifugally cast composit roll for use in a rolling mill capable of preventing deterioration of a connecting portion of a lower pouring sprue to a mold assembly of shaft portion lower mold while upper and lower metal pouring are simultaneously practisized and also of obtaining uniform thickness of the outer shell.

The disclosure also relates to a device for disposing the lower side pouring sprue runner used in the method.

5 Claims, 4 Drawing Figures

METHOD OF MANUFACTURING LARGE-SIZED CENTRIFUGALLY CAST COMPOSITE ROLL AND DEVICE FOR DISPOSING LOWER SIDE POURING SPRUE RUNNER USED IN THE METHOD

BACKGROUND OF THE INVENTION

1. Field of the Invention

This invention relates to improvements in the method of manufacturing a roll in which the shell portion of the body, the body core portion, and both shaft portions (right and left) of a large-sized roll for use in a rolling mill are integrally cast of different kinds of metal (alloyed metal) so as to be adapted for the different properties demanded from reasons of use and to a device preferably used for practising the method and more particularly to a device for disposing a lower side pouring sprue runner.

2. Prior Art

When the working outer shell (a surface of a roll body portion) of a roll, right and left shaft portions and a roll body core portion are different in required mechanical properties from each other, it was a practice to have recourse to such a centrifugal casting method as that in which molten metal for making the outer shell portion is cylindrically poured into a mold for a shell portion of a roll and hardened, thereafter the mold for a body portion of the roll is set upright, molds for shaft portions are assembled on the upper and lower ends of the body portion mold, molden metal is poured into the molds for the shaft portions and the body core portion to thereby integrally cast both the shaft and the body core portions.

In pouring molten metal for the shaft portions and the body core portion, the method described above makes it necessary not only to reduce as much as possible the time from after the centrifugal casting of the shell portion until removal of a body portion mold from a centrifugal casting machine, assembling the body portion mold with upper and lower shaft molds, and pouring molten core metal into the molds thus assembled, in order to prevent the temperature of outer shell metal from falling after it was hardened and to effect complete welding of the shell metal with the core metal poured, but also to consider that the high-temperature molten core metal may not cause any partial melting of the outer shell and may not produce non-uniformity in the thickness of the shell surface layer.

In pouring a molten core metal material, it was a practice to pour the material either through a lower pouring sprue runner connected beforehand integrally to a mold below the shaft portion or by an upper pouring method, and such a practice involves nothing troublesome so long as a roll to be cast is of such a small or a middle size as is at most about 900 mm or less in body diameter and about 2000 mm or less in body length. But when it comes to manufacturing such a large-sized roll as 1000 – 1250 mm in body diameter, 4500 – 5500 mm in body length, and 8000 – 9000 mm in overall length, it becomes necessary to use large molds, spend much time in assembling molds, and pour a large quantity of molten metal, and in addition there is a possibility that non-uniformity may be produced in the thickness of an outer shell and insufficiency may occur in the welding of the outer shell material to a core material.

Namely, it was always a problem that pouring the molten core material merely by a lower pouring method or an upper pouring method was too slow in casting speed. And further because the roll was long in body length, having recourse to one-way pouring method alone such as a lower pouring or an upper pouring method essentially increased the amount of the molten core material which passed in contact with either the lower or upper part alone of the outer shell portion, and in consequence the thickness of the outer shell wall either in the lower or in the upper area alone tended to be reduced in a greater degree than that in the other, thus there arising a problem which makes it difficult to obtain a uniform thickness of layer.

In addition thereto, the large-sized roll essentially resulted in an increase in the size of a mold for casting the roll, which fact, in turn, required much time in assembling the molds, which ultimately delayed starting to pour the molten core material. Especially, in the case where a lower pouring method is employed, the problem of damage given to a sprue runner by the vibrations resulting from asembling of molds was bottle-neck. Namely, the mold for the body portion of a large-sized roll is almost 2000 mm in outer diameter and 7000 mm in body length and as heavy as about 80 tons. After an outer shell was cast by centrifugal casting in such a large-sized body mold, the mold has to be removed from the centrifugal casting machine, set upright and assembled on the lower shaft portion mold beforehand mounted in the pit. But because the mold is large in size and heavy in weight, hasty assembling of molds provides eccentricity and wrong levelling of the molds, which in turn imparts heavy vibration to the lower mold to thereby damage the mold. And what makes matters worse, when a lower pouring sprue runner is connected to the lower mold, the overall length of a sprue runner amounts to as long as 9 to 10 m and vibration is transmitted to the sprue runner and damages the lining of the sprue runner and reduces the fixing of the sprue runner to the lower mold, with the result that attention on the part of workers to such a possibility would eventually demand scrupulous care and much time. Even when the sprue runner is connected to the lower mold after assembling of molds is over, crane operation involved in the connection would require unexpectedly much time in positioning the sprue runner without swinging and in fixing fastening pieces, stays, etc.

SUMMARY OF THE INVENTION

This invention has for its object the solution of the problems described above which have arisen inherently in the manufacture of a large-sized centrifugally cast composite roll, and is designed to practise upper and lower pouring at the same time for obtaining uniform thickness of the outer shell and to hold a lower pouring sprue runner in readiness by setting the runner apart from the shaft portion lower mold at a space sufficient to prevent the transmission of vibrations from the specified setting and connecting position so as to remove the possible damage to the runner, prevent deterioration of fixed portions and improve bad workability for connection and disposition of the runner and is designed to set and connect the sprue runner to the specified position immediately after setting of a body portion mold and the lower mold is over and to hold the sprue runner substantially upright and unswingingly not only during movement of the runner for holding the runner in readiness and for setting the runner but also even during the cycle of molten metal pouring.

DESCRIPTION OF THE PREFFERED EMBODIMENT

Figure 1:
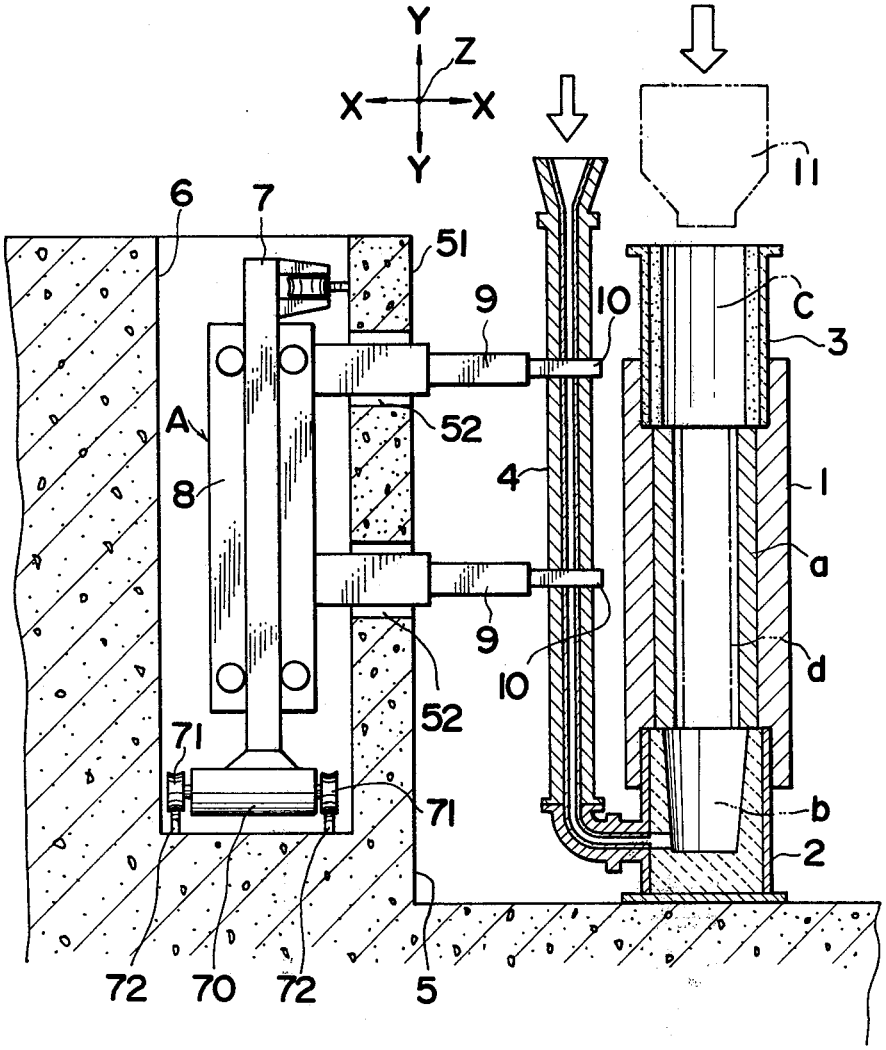
FIG. 1 is a longitudinal sectional view of an entire mold device for casting a large-sized centrifugally cast composite roll according to the invention, the device being shown as a lower pouring sprue runner being in a state of being set on and connected to the mold.

The method of the invention is a method of manufacturing a large-sized centrifugally cast composite roll which method is characterized in that it comprises a first step of centrifugally casting a body shell *a* by use of a body portion mold 1, a second step of setting the body mold 1 upright inside a casting pit 5 after the body shell *a* was hardened and assembling a shaft portion lower mold 2 with the lower portion of the mold 1, a third step of connecting a lower pouring sprue runner 4 to the shaft portion lower mold 2, a fourth step of assembling a shaft portion upper mold 3 with the upper part of the body portion mold 1, and a fifth step of combinedly using upper pouring and lower pouring for the body portion mold 1 and shaft portion upper and lower molds 3, 2 thus assembled, pouring molten metal into the molds both for two shaft portions *b* and *c* and for a body core portion *d* and integrally casting the body portion shell *a*, the two shaft portions *b* and *c*, and the body core portion *d* and in that the third step 3 holds the sprue runner 4 unswingingly and substantially uprightly in a casting pit 5, positioning the runner 4 with respect to the specified position of the shaft portion lower mold 2 and thereafter keeps the runner in readiness in the position nearest to the shaft portion lower mold apart from the mold 2 at a space sufficient to prevent transmission of vibration, and the runner 4 is set and connected to the lower mold 2 immediately in succession to the completion of the second step.

Figure 4:
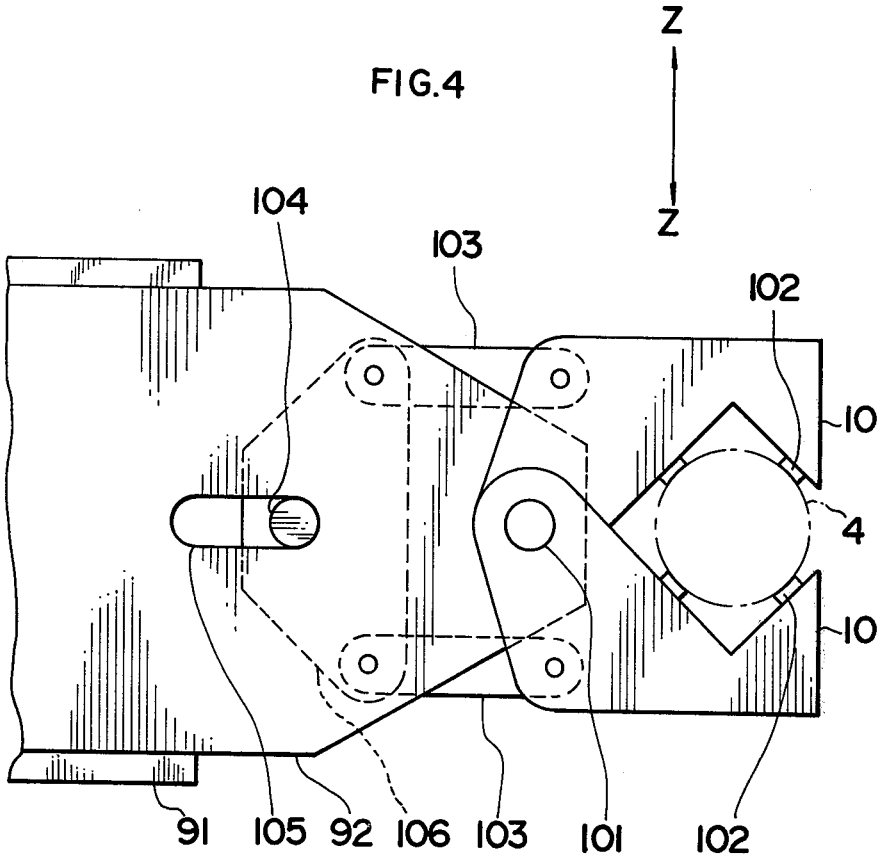
FIG. 4 is a plan view of an essential part of the device.

Out of the steps of manufacture described above, the characteristic features of the invention are those which are constituted by the third and fifth steps. And a description will be given of the invention with special emphasis on those steps. First, a preferred device A for practising the third step, as shown in FIG. 1, is a device for disposing a lower pouring sprue runner 4 with respect to a mold assembly of a shaft portion lower mold 2, a body portion mold 1 and a shaft portion upper mold 3 connected to each other upright inside a casting pit 5, and the device comprises an accommodating chamber 6 provided in substantially parallel to the casting pit 5 in the interior of one side wall 51 by passing through a part of the side wall 51 of the pit 5, an upright guide pole 7 housed in the chamber 6 and movable back and forth with respect to the pit 5, a frame 8 movable vertically with respect to the pole 7, a pair of upper and lower support arms 9, 9 projecting from the pole through upper and lower openings 52 and 52 of the pole through upper and lower openings 52 and 52 of the side wall 51 into the pit 5 and movable bilaterally with respect to the frame 8, chuck pawls 10, 10 formed respectively at the ends of the support arms 9, 9, and independent hydraulic mechanisms respectively causing the above members to move in the back and forth, up and down, and right and left directions respectively, and constitutes a divece for disposing a lower sprue runner used in the manufacture of a large-sized centrifugally cast composite roll and for gripping the lower sprue runner 4 inside the pit 5 unswingingly and uprightly by the chuck pawls 10, 10 at the ends of the support arms 9, 9 so as to make it possible for the lower sprue runner to move freely back and forth, right and left, and up and down. More particularly, the guide pole 7 is set up on a base 70, the base 70 is movable by the rollers 71, 71 attached thereto which rollers move along rails 72, 72 laid on the bottom of the accommodating chamber 6 and also movable by roller 73 at the upper end of the pole 7 along a rail 74 laid on the side wall 51, thus the pole 7 being designed to be non-topplingly and freely movable back and forth (in a Z-direction) and the movement of the pole 7 being effected by a hydraulic device (not shown). The frame 8 rolls through rollers 75 . . . along the pole 7 and is free to be moved up and down (in a Y-direction) along the pole 7 by a hydraulic mechanism (not shown). The support arm 9 comprises a fixed outer cylinder 19 and a movable inner cylinder 92, the inner cylinder 92 being adapted to be freely extended and retracted by a hydraulic mechanism (not shown) in a bilateral direction (in an X-direction) of the arms, and the chuck pawls 10, 10 at the ends of the arms, as shown in FIG. 4, are constructed in the manner that a slot 105 is formed in the movable inner cylinder 92 inserted around the same pawl shaft 101 as that around which the chucks 10, 10 are inserted, a working plate 106 having a pin 104 loosely fitted into the slot 105 is slidable longitudinally of the support arm 9 inside the cylinder 92, the working plate 106 is connected by links 103, 103 respectively to the pawls 10, 10 and further the plate 106 is connected to a hydraulic mechanism (not shown) and slidable within the range of length of the slot 105 so as to permit closing of the pawls 10, 10 in the front position of the plate 106 and to permit opening of the pawls 10, 10 in the retracted position of the plate 106. Numeral 102 designates a packing as of rubber.

Secondly, characteristic essentials of the fifth step lie in the practising of upper pouring together with lower pouring. Previously, mention was made of the conventional practice in which either upper or lower pouring alone is applied to the manufacture of this kind of roll, but an attempt to make simultaneous application of both upper and lower pouring has never been made. In practising this upper pouring method, a funnel 11 is placed on the top of the mold shown in FIG. 1.

Figure 2:
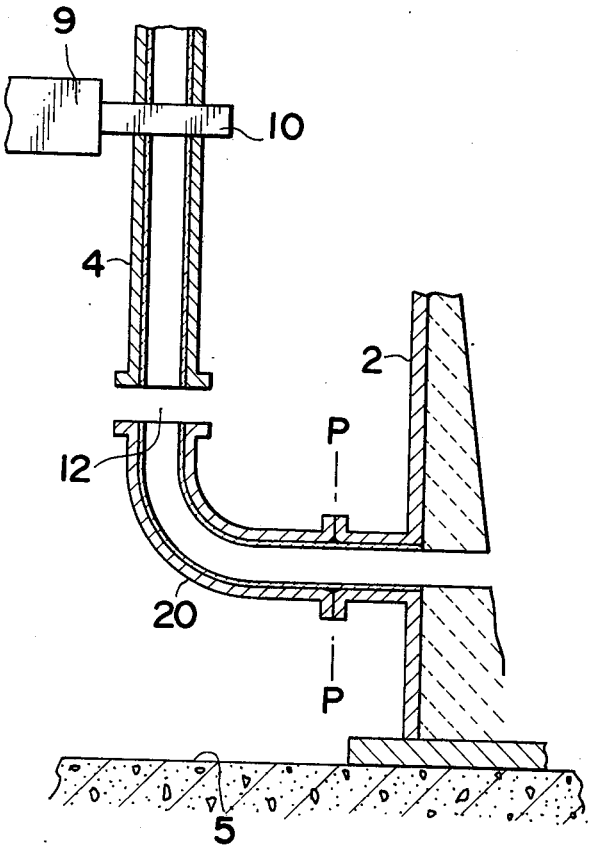
FIG. 2 is an enlarged schematic view of an essential part of FIG. 1 and showing the state of the sprue runner being separated from the mold and being held ready for attachment to the mold.
Figure 3:
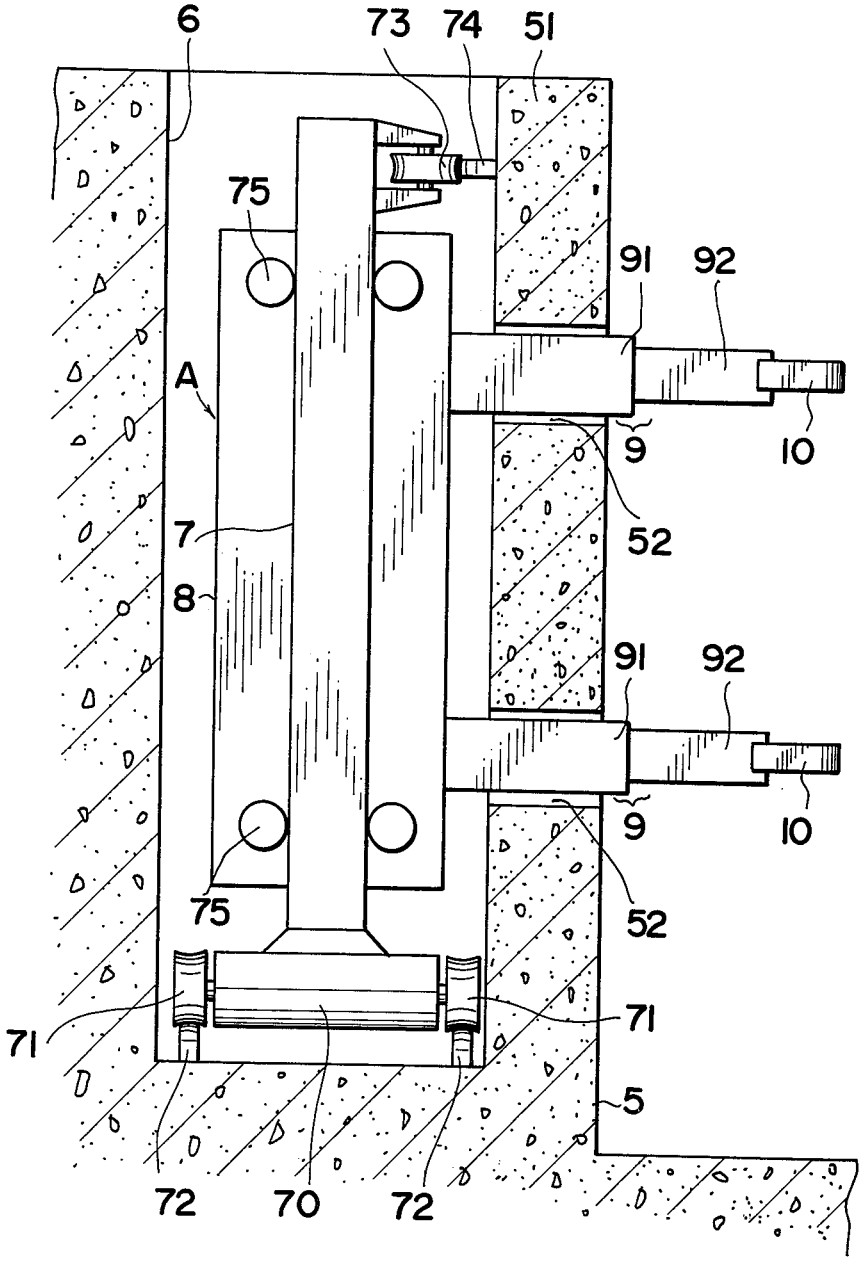
FIG. 3 is a side view of the molten metal pouring sprue runner disposing device used in the invention.

Referring now to the way of embodying the invention by use of the mold assembly and device described above, a lower sprue runner 4 is gripped upright by the pawls 10, 10 of the support arms 9, 9 at two points of the runner longitudinally of runner 4 inside the casting pit 5, the lower end portion of the runner 4 is adjusted in position with respect to the shaft portion lower mold 2 before the body portion mold 1 is transferred into the pit 5 and that point of the end portion of the runner thus adjusted in position is properly marked. And as shown in FIG. 2, the runner 4 is held in readiness for connection to the mold 2 at a place nearest to the mold 2 at a small space apart from the mold 2 (actually in the embodiment shown is a runner inlet 20 for the mold 2) i.e. at a space 12 sufficient to prevent transmission of vibration. In this state, the body portion mold 1 which has finished centrifugal casting is set upright on the shaft portion lower mold 2 and immediately after the setting of the mold 1 is over, a device A is operated to thereby quickly shift the runner to the mold 2 and set and connect the runner thereto. In the state of the upper part being spaced apart from the lower part of the runner 4 as shown in FIG. 3, the mentioned shifting is chiefly effected in the Y-direction of the device A, but because the device can freely be shifted both in the direction of Y and in the direction of Z, adjustment in these directions can also be possible. After the connection of the runner 4 to the mold 2 is completed, an upper mold 3 is set on the top of the mold 1 and a funnel 11 is disposed on the top of the mold 3, whereby the mold device shown in FIG. 2 is assembled. It should be understood that separation of the runner 4 may be made along the line P — P in FIG. 2 instead of the embodiment shown.

Immediately after the mold device of the type described has been completed, pouring of molten metal by a combination of upper and lower pouring provides a desired composite roll and it is of course necessary to hold the runner 4 by the arms 9, 9 in an upright position as shown in FIG. 1 but there is no necessity whatsoever of fixing the runner 4 with a stay or the like.

After pouring is over and the molten metal is hardened, the molds 3, 1 and 2 are disassembled to take out the product therefrom, and again another body mold 1 is transferred into the pit. During the transfer, the runner 4 is adjusted in posisioning with respect to the mold 1 in the same manner as described above.

As will have been understood from the description so far given, the invention provides the following advantages:

(A) Since setting and connection of the runner 4 to the lower mold 2 is made after the mold 1 is assembled with the lower mold 2 and since the runner 4 is spaced apart from the mold 2 at a space 12 during such assembling, there is no possibility of the vibration during the time of assembling of the molds being transmitted to the runner 4 and damaging the connected part and fire-resistant inner lining layer. Accordingly, such mold assembling itself is speeded up.

(B) Because the runner 4 is not only held spaced apart from the mold 2 and in a unswinging and upright state after adjustment of setting of the runner 4 is over, but also held in readiness for connection at a position nearest to the lower mold 2, it is possible to shift the runner 4 to the lower mold 2 quickly and accurately in a minimum distance of shift and by manual operation for position adjustment. Namely, the time required for the operation above is greatly reduced and operation itself can be done with much ease.

(C) Elevation of the temperature of the outer shell *a* can be restricted to a minimum by the advantageous features in Items A) and B) and pouring of a molten core material can be done at a most favorable opportunity.

(D) Because upper pouring and lower pouring are carried out at the same time, the time for casting is speeded up and the amount of molten metal that passes in contact with the inner surface of the shell *a* is reduced to half of that in the case of an exclusive upper or lower pouring and damage done by melting to the inner surface of the shell *a* is also smaller, and even if there comes out certain damage, the damage becomes equal in degree both in the upper and in the lower portion, with the result that the outer shell *a* with small fluctuation and substantial uniformity in thickness can be obtained.

(E) Weldability between the outer shell *a* and the body core portion *d* and both shaft portions *b, c* is improved by Items (C) and (D) and accordingly a good quality centrifugally cast composite roll is obtained. The characteristic features described above make this invention highly significant for the manufacture of this type of roll.

Having described my invention as related to the embodiment shown in the accompaning drawing, it is my intention that the invention be not limited by any of the details of description, unless otherwise specified, but rather be construed broadly within its spirit and scope as set out in the accompanying claims.

I claim:

1. A method of manufacturing a large-sized centrifugally cast composite roll, said method being characterized in that it comprises:

centrifugally casting a body shell by use of a body portion mold;

setting said body portion mold upright inside a casting pit after said body shell was hardened and assembling a shaft portion lower mold with the lower portion of said body portion mold;

positioning a lower pouring sprue runner and holding said runner unswingingly and substantially upright in said casting pit at a predetermined position adjacent said body portion mold but spaced a sufficient distance from said shaft portion lower mold to prevent the transmission of vibration from said shaft portion lower mold to said sprue runner;

quickly connecting said runner to said shaft portion low mold; and assembling a shaft portion upper mold with the upper portion of said body portion mold; and simultaneously pouring molten metal into said shaft portion upper mold and into said sprue runner into said shaft portion lower mold to integrally cast said body portion shell, said two shaft portions, and said body core portion.

2. A method according to claim 1 wherein the unswinging and upright state in said casting pit of said sprue runner is provided by chuck pawls at the ends of arms gripping said sprue runner at least at two points of the runner longitudinally of the runner.

3. A method according to claim 1 wherein said lower pouring spure runner is set apart from and connected to said shaft portion lower mold at the upper end of a runner inlet for said mold.

4. A method according to claim 1 wherein said lower pouring sprue runner is set apart from and connected to said shaft portion lower mold at the lower end of a runner inlet for said mold.

5. A method of manufacturing a large-sized centrifugally cast composite roll, said method being characterized in that it comprises:

centrifugally casting a body shell by use of a body portion mold, wherein said mold for the body portion of a large-sized roll is almost 2,000 mm in outer diameter and 7,000 in body length and as heavy as about 80 tons;

setting said body portion mold upright inside a casting pit after said body shell was hardened and assembling a shaft portion lower mold with the lower portion of said body portion mold;

positioning a lower pouring sprue runner and holding said runner unswingingly and substantially upright in said casting pit at a predetermined position adjacent said body portion mold but spaced a sufficient distance from said shaft portion lower mold to prevent the transmission of vibration from said shaft portion lower mold to said sprue runner;

quickly connecting said runner to said shaft portion lower mold; and assembling a shaft portion upper mold with the upper portion of said body portion mold; and simultaneously pouring molten metal into said shaft portion upper mold and into said sprue runner into said shaft portion lower mold to integrally cast said body portion shell, said two shaft portion, and said body core portion.

* * * * *